US005143700A

United States Patent [19]

Anguil

[11] Patent Number: 5,143,700

[45] Date of Patent: Sep. 1, 1992

[54] CERAMIC FILTER CONSTRUCTION FOR USE IN CATALYTIC INCINERATION SYSTEM

[75] Inventor: Gene H. Anguil, Milwaukee, Wis.

[73] Assignee: Anguil Environmental Systems, Inc., Milwaukee, Wis.

[21] Appl. No.: 597,497

[22] Filed: Oct. 15, 1990

[51] Int. Cl.[5] ..... F01N 3/08

[52] U.S. Cl. ..... 422/176; 422/177; 422/178; 422/182; 55/96; 55/523; 55/DIG. 30

[58] Field of Search ..... 422/173, 176, 177, 178, 422/182; 55/96, 283, 523, DIG. 30, 282

[56] References Cited

U.S. PATENT DOCUMENTS

| | | | |
|---|---|---|---|
| 3,908,367 | 9/1975 | Bauman | 60/280 |
| 3,926,702 | 12/1975 | Oki | 156/89 |
| 3,996,015 | 12/1976 | Hutchings | 23/288 |
| 4,299,600 | 11/1981 | Kobashi | 422/176 |
| 4,427,418 | 1/1984 | Kogiso et al. | 55/523 |
| 4,436,535 | 3/1984 | Erdmannsdörfer et al. | 422/178 |
| 4,481,767 | 11/1984 | Stark | 55/DIG. 30 |
| 4,503,672 | 3/1985 | Stark et al. | 55/DIG. 30 |
| 4,544,526 | 10/1985 | Billings | 422/173 |
| 4,573,317 | 3/1986 | Ludecke | 55/DIG. 30 |
| 4,629,483 | 12/1986 | Stanton | 55/487 |
| 4,678,643 | 7/1987 | Fetzer | 422/175 |
| 4,983,364 | 1/1991 | Buck et al. | 422/182 |

OTHER PUBLICATIONS

Anguil Environmental Systems, Inc. Brochure.

*Primary Examiner*—Robert J. Warden
*Assistant Examiner*—Krisanne M. Thornton
*Attorney, Agent, or Firm*—Andrus, Sceales, Starke & Sawall

[57] ABSTRACT

A ceramic filter construction having particular use for removing particulate material in a catalytic incineration system. The ceramic filter is mounted in a plenum through which exhaust gas containing particulate material is conducted. Particulate material is removed from the gas stream as it flows through the ceramic filter. To automatically clean the filter, a fuel burner is located upstream of the filter and extends across the plenum and divides the plenum into a pair of flow paths which merge downstream of the burner adjacent the filter. During the cleaning cycle, the burner directs a flame toward the filter. A damper is positioned in each flow path and the dampers can be independently operated to vary the volume of gas in each flow path and deflect the flame to cause the flame to translate across the surface of the filter to burn off combustible material adhered to the filter.

6 Claims, 2 Drawing Sheets

FIG. 1
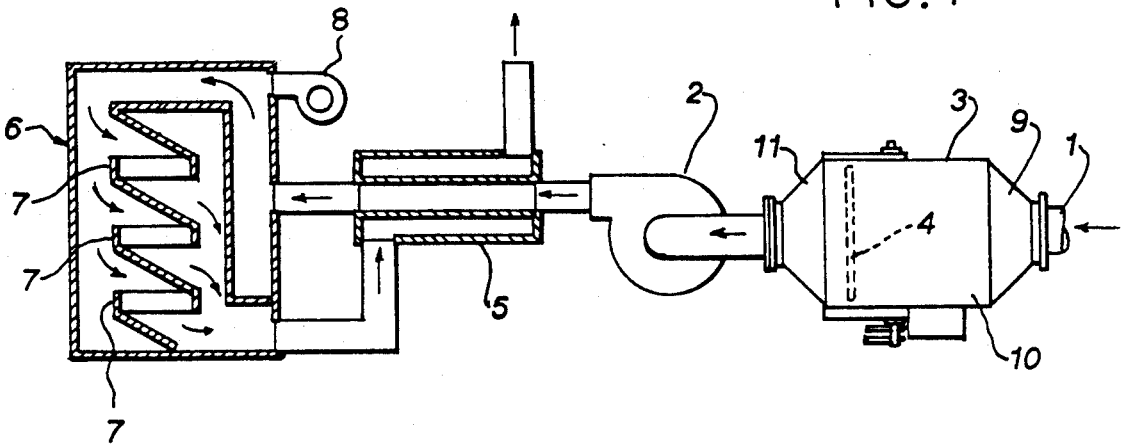
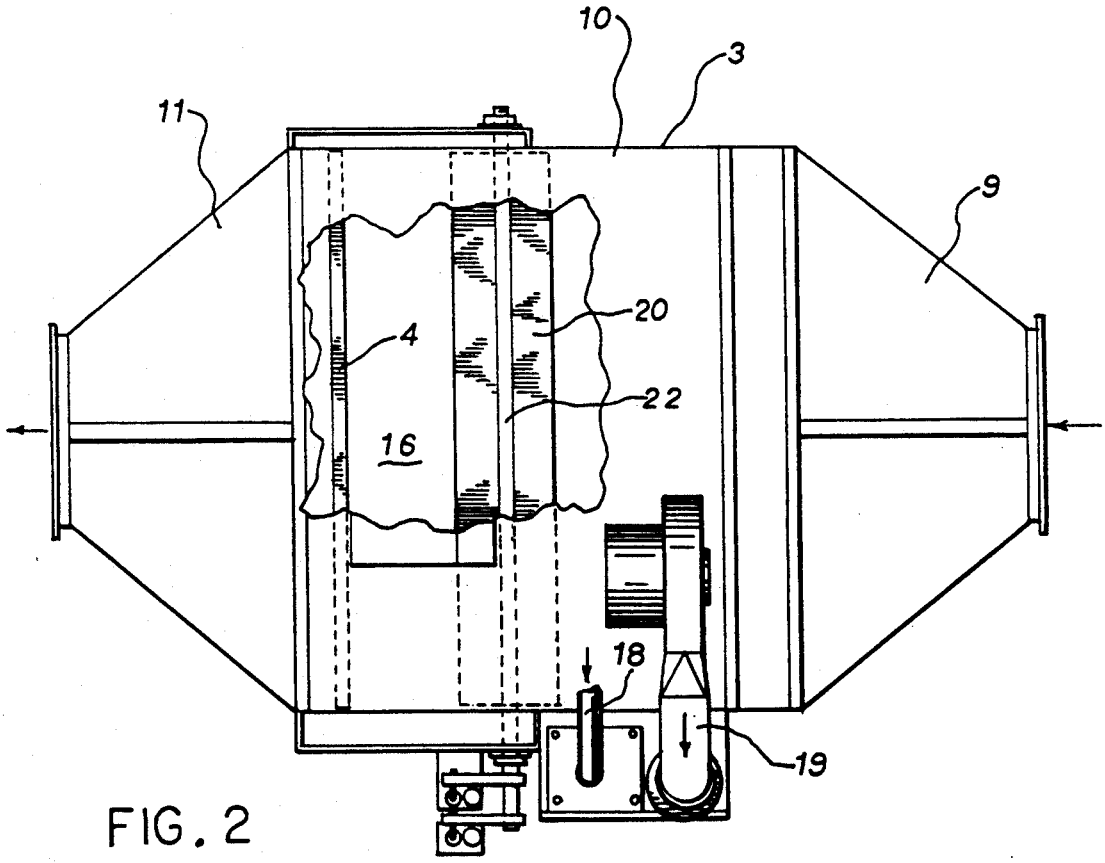
FIG. 2

CERAMIC FILTER CONSTRUCTION FOR USE IN CATALYTIC INCINERATION SYSTEM

BACKGROUND OF THE INVENTION

Catalytic incineration systems are used to remove volatile organic compounds and odors from exhaust gases. In a typical catalytic incineration system, the gas is directed across a catalytic material which can constitute a noble metal, such as platinum, or alternately a base metal such as manganese dioxide. The catalytic bed is operated at a temperature in the range of about 500° F. to 800° F., and serves to convert hydrocarbons in the gas to carbon dioxide and water vapor. A catalytic incineration system has distinct advantages over a thermal fume system, due to the fact that the thermal fume system operates at higher temperatures in the neighborhood of 1400° F. and thus has higher energy requirements.

To conserve energy, most catalytic incineration systems incorporate a heat exchanger in which the incoming gas is preheated by the gas being discharged from the catalytic reactor. It has been found that if a gas is heavily laden with particulate material, the particulates will tend to condense on the heat exchanger core resulting in a loss of heat transfer effectiveness, and will also condense and clog the catalyst, resulting in a substantial loss of catalytic activity. Because of this, catalytic incineration systems have not been successfully utilized with gases containing high proportions of particulate material.

SUMMARY OF THE INVENTION

The invention is directed to a ceramic filter construction having particular use for removing particulate materials in a catalytic incineration system. According to the invention, a gas permeable ceramic filter is mounted across a plenum through which the exhaust gas is conducted. The plenum is located upstream of the heat exchanger and catalytic reactor so that particulate material in the gas stream is removed by the filter before the gas enters the heat exchanger and catalytic reactor. The invention also incorporates an automatic cleaning mechanism which will remove material adhering to the filter. In this regard, a fuel burner is located upstream of the filter and extends across the plenum and divides the plenum into a pair of flow paths, which merge downstream of the burner assembly adjacent the upstream surface of the filter. In normal operation, the incoming gas is directed into the pair of flow paths and then passes through the filter where particulate materials, both organic and inorganic, are removed from the gas stream. The gas then passes through the heat exchanger where it is preheated and then to a conventional catalytic reactor where the hydrocarbons are converted to carbon dioxide and water. The gases discharged from the catalytic reactor pass through the heat exchanger to preheat the incoming gas and are then discharged to the atmosphere.

The cleaning cycle is initiated when a predetermined pressure drop is measured across the filter. The burner in the cleaning cycle, directs a flame toward the filter. A damper is positioned in each of the flow paths and can be independently operated to vary the volume of gas flowing through each flow path to thereby deflect the flame and cause the flame to translate across the surface of the filter to burn off combustible materials adhered to the filter.

With the invention, the ceramic filter is automatically cleaned while the system is operating, thereby eliminating any downtime for cleaning or replacement of the filter.

Through use of the cleaning cycle, the organic constituents adhering to the filter are vaporized and pass through the system to the catalytic reactor, while the inorganic constituents on the filter decompose and the ash will be collected in the bottom of the plenum.

The material adhering to the filter, if not removed, would constitute hazardous waste, which presents a disposal problem. Thus, through use of the automatic cleaning system of the invention, the disposal of such hazardous waste is eliminated.

As the ceramic filter removes the particulate material from the gas stream, condensation of the particulate in the heat exchanger or catalytic reactor is prevented, enabling the catalytic incineration system to be utilized with a greater variety of exhaust gases.

Other objects and advantages will appear in the course of the following description.

DESCRIPTION OF THE DRAWINGS

The drawings illustrate the best mode presently contemplated of carrying out the invention.

In the drawings:

FIG. 1 is a schematic flow diagram showing the ceramic filter construction of the invention, as incorporated in a catalytic incineration system;

FIG. 2 is a top plan view with parts broken away in section showing the plenum containing the filter;

DESCRIPTION OF THE ILLUSTRATED EMBODIMENT

Figure 3:
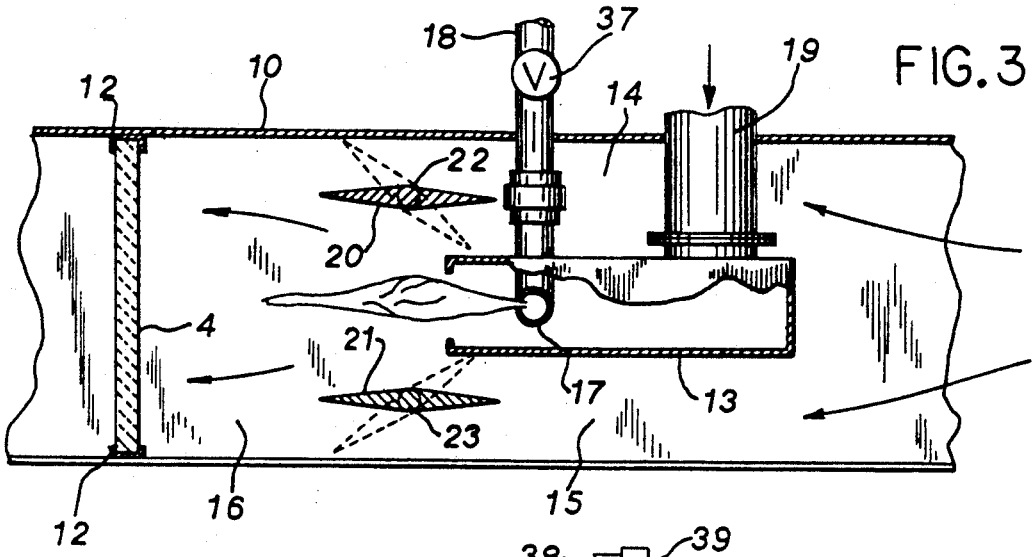
FIG. 3 is a side elevation with parts broken away in section.

FIG. 1 is a flow diagram showing the use of the ceramic filter construction of the invention as incorporated in a catalytic incineration system. The gas containing a substantial portion of particulate material is drawn into the incineration system through conduit 1 by blower 2 to a collection plenum 3 which contains a ceramic filter 4. After passing through the filter, the gas then flows through a heat exchanger 5 and into the catalytic reactor 6 where the hydrocarbons in the gas are converted to carbon dioxide and water. The gas is then discharged from the reactor through heat exchanger 5 to the atmosphere.

The reactor 6 is of conventional construction and can contain a noble metal catalyst, such as platinum, or the catalyst can be a base metal such as manganese dioxide. In the preferred form of the invention, the catalyst is contained in beds on a series of superimposed trays 7 and the gas is directed by baffles downwardly through the beds to convert the hydrocarbons. A fuel burner 8 is mounted in the catalytic reactor, and suitable temperature sensors are disposed in the reactor and are operably connected to the burner to maintain the temperature of the catalytic beds in the range of about 500° F. to 800° F.

The construction and operation of the catalytic reactor itself is standard and in itself forms no part of the invention.

Heat exchanger 5 is of a conventional type and can either be a shell and tube type heat exchanger or a plate-type heat exchanger. As previously noted, the heat exchanger serves to pre-heat the incoming gas by transferring heat from the gas discharged from the reactor 6 to the incoming gas. Through use of the heat exchanger, the incoming gas can be heated to a sufficient temperature such that no auxiliary fuel is required by the catalytic reactor, thus providing an energy savings.

As best shown in FIGS. 2 and 3, plenum 3 includes a funnel-shaped inlet 9, a generally rectangular central section 10, and a funnel-shaped outlet section Ceramic filter 4 is removably mounted in section 10 by channel-shaped guides 12. Filter 4 extends completely across the plenum and can consist of a sing]e block of ceramic material or alternately a series of smaller ceramic blocks can be arranged edgewise to extend across the plenum. The filter 4 preferably takes the form of a block approximately one inch thick containing approximately 300 cells per square inch. The ceramic material can be a material, such as aluminum oxide, or the like. Alternately, the ceramic filter can be formed of ceramic foam material, or randomly oriented ceramic fibers that are bonded together at their points of crossover.

Particulate material contained in the exhaust gas will collect on the filter 4, so that the gas entering the heat exchanger 5 and catalytic reactor 6 will be o substantially free of particulate material which could condense on either the heat exchanger core or the catalyst.

The invention includes a cleaning mechanism which automatically removes material that collects on filter 4. In this regard, a burner housing 13 is mounted in central section 10 of the plenum and divides the central section into an upper passage 14 and a lower passage 15. The downstream ends of passages 14 and 15 communicate with chamber 16, which is located upstream of filter 4.

An elongated fuel burner 17 is mounted in burner housing 13 and extends the entire width of the plenum. A fuel supply conduit 18 is connected to one end of burner 17 and the burner 17 is provided with an elongated outlet slot through which the gas fuel is discharged. Combustion air is supplied to the housing 13 through air supply line 19. The air is mixed with the gas fuel being discharged from the burner 17 and the mixture is ignited by a suitable ignition device, not shown, to provide an elongated flame that extends substantially the entire width of the plenum 3 and is directed toward the filter 4.

The cleaning mechanism also has a provision for progressively moving the heating means or flame across the surface of the filter 4. In this regard, an upper damper 20 is mounted in passage 14, while a lower damper 21 is mounted in the passage 15. Dampers 20 and 21 extend the complete width of plenum 3 and can be moved between a generally horizontal open position and an angular closed position.

Upper damper 20 is mounted on a shaft 22, and similarly lower damper 21 is mounted on shaft 23. The ends of shafts 22 and 23 are journaled within bearing assemblies 24 attached to the respective side walls of plenum 3.

Figure 4:
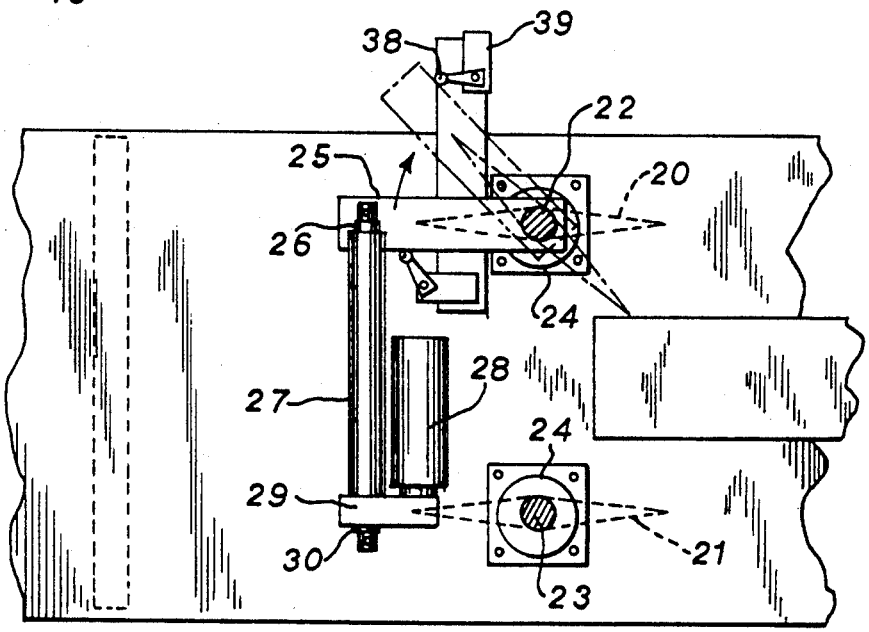
FIG. 4 is an enlarged fragmentary side elevation showing the operating mechanism for the upper damper.

To pivot the upper damper 20 between the open and closed positions, an arm 25 is connected to the end of shaft 22 and is located outside the side wall of the plenum, as seen in FIG. 4. The end of arm 25 is pivotally connected to the upper end of a lead screw 26 of linear actuator 27. The linear actuator is driven by an electric motor 28, which is connected through a gear reduction mechanism 29 to the lead screw. Linear actuator 27 is secured in fixed relation to the side wall of the plenum through a mounting bracket 30.

With this construction, operation of motor 28 will extend and withdraw the lead screw 26 to pivot the damper 20 between the open and closed positions. In the closed position, as shown by the dashed lines in FIG. 3, damper 20 will substantially close off passage 14 to the flow of gas.

Figure 5:
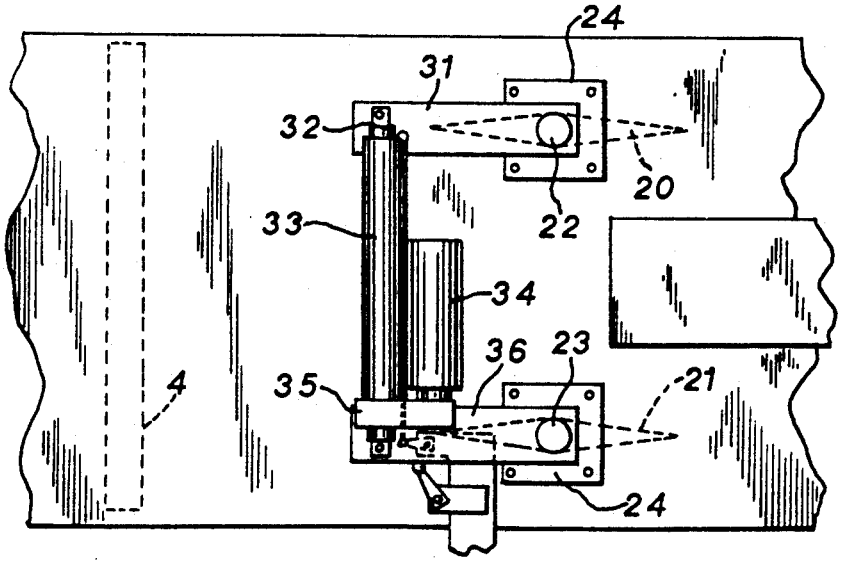
FIG. 5 is a view similar to FIG. 4 showing the operating mechanism for the lower damper.

The mechanism for pivoting the lower damper is best illustrated in FIG. 5. An arm 31 is connected to the projecting end of the upper shaft 22, and the end of arm 31 is pivotally connected to the upper end of lead screw 32 of linear actuator 33. Actuator 33 is driven by a motor 34 acting through a gear reduction mechanism 35.

The actuator 33 is mounted on an arm 36 which is connected to the lower shaft 23 that carries the lower damper 21. With upper shaft 22 and arm 25 fixed by linear actuator 28, operation of actuator 33 will pivot arm 35 to thereby pivot damper 21. When in the closed position, damper 21 will prevent flow through passage 15.

During normal operation of the incineration system, both dampers 20 and 21 are in the open position. A pressure sensing mechanism is utilized to measure the pressure differential across the filter 4 and the pressure sensor can take the form of a photohelix gauge. When a predetermined differential is measured, resulting from clogging of the filter, the cleaning cycle is initiated by opening valve 37 in fuel supply line 18 to supply fuel to the burner, and actuating the ignition mechanism to ignite the fuel-air mixture. Simultaneously, linear actuator 33 is operated to move the lower damper 21 to the closed position, while the upper damper 20 is locked in the open position. As the volume of air being drawn into the plenum 3 is constant, substantially the entire volume will then pass through the upper passage 14 into the chamber 16. The air passing downwardly into chamber 16 will deflect the flame downwardly toward the lower end of the filter 4, to thereby volitalize the organic materials from this area of the filter.

The actuators 27 and 33 are then operated in unison, causing the lower damper 21 to move from the closed toward the open position and the upper damper 20 to move from the open toward the closed position. This operation of the dampers will cause the flame to progressively move upwardly across the surface of the filter 4. When the upper damper 20 reaches its closed position (the lower damper then being open), the upper damper will contact a limit switch 38 mounted on bracket 39 which will reverse the operation of actuator 27 to move the upper damper 20 back to the open position, thus terminating the cleaning cycle with both dampers being in the open position. In practice, the cleaning cycle may take in the neighborhood of about 60 minutes, and is accomplished while the system is operating without shutting down the flow of exhaust gas to the catalytic reactor.

Filter 4 acts to remove particulate material from the gas stream, thereby enabling a catalytic incineration system to handle particulate laden gas streams.

As a further advantage, the particulate material collected on the ceramic filter is automatically destroyed, so that there is no problem of disposal of filters containing hazardous waste.

Various modes of carrying out the invention are contemplated as being within the scope of the following claims particularly pointing out and distinctly claiming the subject matter which is regarded as the invention.

We claim:

1. A ceramic filter construction operable in an incineration mode and a cleaning mode, comprising a plenum defining a flow path for a gas containing particulate material and having an upstream end and a downstream end, a gas permeable ceramic filter disposed in said plenum and having an upstream surface, fuel burner means disposed in said plenum and spaced upstream of said filter and dividing said plenum into a pair of gas flow passages, said burner means being constructed and arranged to direct a flame toward said surface, damper means disposed in each flow passage to control the flow of gas through the respective passage, each damper means being movable between a closed position and an open position, said damper means both being open during the incineration mode so that gas will flow through both passages on opposite sides of the flame, and operating means for independently moving each damper means between the open and closed positions during the cleaning mode to cause a differential in the volume of gas passing through said passages and on opposite sides of said flame to thereby deflect and direct the flame across said surface.

2. The construction of claim 1, and including means responsive to a pressure differential across said filter for actuating said operating means.

3. The construction of claim 1, wherein said burner means extends completely across said plenum and is provided with an elongated discharge slot to produce an elongated flame.

4. The construction of claim 1, wherein said operating means including means for progressively moving each damper means between the closed and open positions.

5. The construction of claim 1, wherein said operating means includes means for moving a first of said damper means to a closed position while retaining the second damper means in an open position, and means for progressively moving said first damper means from a closed position to an open position and simultaneously moving said second damper means from the open position to the closed position.

6. A ceramic filter construction operable in an incineration mode and a cleaning mode, comprising a plenum defining a flow path for a gas containing particulate material and having an upstream end and a downstream end, a gas permeable ceramic filter disposed in said plenum and having a generally rectangular upstream surface, fuel burner means disposed in said plenum and spaced upstream of said filter and dividing said plenum into a pair of gas flow passages, said burner means having an elongated outlet and being constructed and arranged to direct a flame through said outlet towards said surface, damper means disposed in each flow passage to control the flow of gas through the respective passages, each damper means being movable between a closed position and an open position, said damper means both being open during the incineration mode so that said gas flows through both of said passages on opposite sides of said flame, and operating means for independently moving each damper means between the open and closed position during the cleaning mode to cause a differential in volume of the gas passing through said passages and on opposite sides of said flame to thereby deflect said flame and direct the flame across said surface.

* * * * *